US008015953B2

(12) United States Patent
Stramecki

(10) Patent No.: US 8,015,953 B2
(45) Date of Patent: Sep. 13, 2011

(54) ELECTRIC COOLING FAN CONTROL BASED ON KNOWN VEHICLE LOAD CONDITIONS

(75) Inventor: Bryan Anthony Stramecki, Farmington Hills, MI (US)

(73) Assignee: DENSO International America, Inc., Southfield, MI (US)

( * ) Notice: Subject to any disclaimer, the term of this patent is extended or adjusted under 35 U.S.C. 154(b) by 594 days.

(21) Appl. No.: 12/079,137

(22) Filed: Mar. 25, 2008

(65) Prior Publication Data

US 2009/0241865 A1 Oct. 1, 2009

(51) Int. Cl.
*F01P 7/02* (2006.01)

(52) U.S. Cl. ..... 123/41.12; 123/41.49; 123/41.48; 123/198 D; 701/99

(58) Field of Classification Search ..... 123/198 D, 123/41.01–41.51; 701/48; 340/440, 441, 340/431, 438

See application file for complete search history.

(56) References Cited

U.S. PATENT DOCUMENTS 4,433,648 A * 2/1984 LeBlanc ..... 123/41.12
4,823,744 A * 4/1989 Omura ..... 123/41.12
7,455,239 B2 * 11/2008 Braun et al. ..... 236/34
7,598,845 B2 * 10/2009 Kanafani ..... 340/425.5
2004/0206099 A1 * 10/2004 Kim ..... 62/178
2005/0203684 A1 * 9/2005 Borgesson ..... 701/36
2006/0202808 A1 * 9/2006 Obradovich ..... 340/425.5
2006/0231314 A1 * 10/2006 Homan et al. ..... 180/233
2006/0287798 A1 * 12/2006 Inoue et al. ..... 701/70

FOREIGN PATENT DOCUMENTS

GB 2142445 A * 1/1985

* cited by examiner

*Primary Examiner* — Michael Cuff
*Assistant Examiner* — Hung Q Nguyen
(74) *Attorney, Agent, or Firm* — Harness, Dickey & Pierce, PLC

(57) ABSTRACT

A method of controlling a cooling fan for an engine of a vehicle may entail determining an engine coolant temperature, providing a normal load operation mode for the cooling fan and a high load operation mode for the cooling fan, determining whether a tow-haul operation is selected within the vehicle, determining a vehicle load of the vehicle by detecting whether a towing load sensor is activated or not activated, determining whether a vehicle load threshold is reached based upon activation of the towing load sensor, and operating the cooling fan. Operating the cooling fan may be based on the coolant temperature and one of the normal load operation mode and the high load operation mode. Operating the cooling fan in the normal load operation mode may mean reducing a cooling fan operation frequency and decreasing a cooling fan operation percentage over a predetermined coolant temperature range.

6 Claims, 4 Drawing Sheets

ELECTRIC COOLING FAN CONTROL BASED ON KNOWN VEHICLE LOAD CONDITIONS

FIELD

The present disclosure relates to controlling engine cooling fans in internal combustion engines.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

The combustion process within an internal combustion engine generates a significant amount of heat. Excessive heat may reduce the reliability of the engine and/or engine components. Furthermore, excessive heat may shorten the lifetime, or the period of reliable use, of the engine and/or individual engine components.

Typically, vehicles employing an internal combustion engine also employ a heat exchanger (e.g., a radiator) that is connected to coolant channels within the engine. Fluid (e.g., engine coolant) circulates through the coolant channels and the radiator while the engine coolant absorbs heat from the engine and carries the heat to the radiator. The radiator transfers the heat from the engine coolant to air passing through the radiator by, for example, convection, thus cooling the engine.

Vehicles may also include a cooling fan to aid in cooling the engine and the engine components. For example, the cooling fan may cool the engine, and more specifically, the cooling fan may cool the engine by removing heat from the engine coolant, by increasing the amount of air passing through the radiator. The cooling fan may be activated, that is, turned ON or made to rotate, when the temperature of the engine coolant reaches a temperature threshold or specific temperature. In this manner, the cooling fan may aid in preventing the engine and the engine coolant from incurring damage from excessive heat.

Typically, a cooling fan operation percentage is determined based on a coolant temperature and a maximum vehicle load. The maximum vehicle load corresponds to a high engine load and a high ambient temperature. However, when the vehicle load is low, the cooling fan operation percentage may be limited while still preventing the engine and the engine coolant from being damaged by excessive engine heat. Limiting the cooling fan operation percentage improves the cooling fan motor durability and reduces noise and power consumption while reducing power consumption increases vehicle fuel efficiency.

Therefore, a need exists for a cooling fan control that determines a cooling fan operation percentage based on a coolant temperature and a maximum vehicle load when a tow-haul operation is selected or the vehicle load exceeds a vehicle load threshold, and that limits the cooling fan operation percentage when a tow-haul operation is not selected and the vehicle load is below the vehicle load threshold.

SUMMARY

A method of controlling a cooling fan for an engine of a vehicle may entail determining an engine coolant temperature, providing a normal load operation mode and a high load operation mode for the cooling fan, determining whether a tow-haul operation is selected or is not selected within the vehicle, determining a vehicle load being subjected to the vehicle by detecting whether a towing load sensor is activated or not activated, determining whether a vehicle load threshold is reached based upon activation of the towing load sensor, and operating the cooling fan. Operating the cooling fan may be based on the coolant temperature and one of the normal load operation mode and the high load operation mode. Operation of the cooling fan in the normal load operation mode means reducing a cooling fan operation frequency and decreasing a cooling fan operation percentage over a predetermined coolant temperature range relative to operating the cooling fan in the high load operation mode. Operation of the cooling fan in the high load operation mode may occur when the vehicle load exceeds the vehicle load threshold. In the high load operation mode, the cooling fan or fans may begin to operate at a coolant temperature of 98 degrees Celsius and at an operation percentage of between 25% and 100% at a predetermined frequency or on and off operation.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
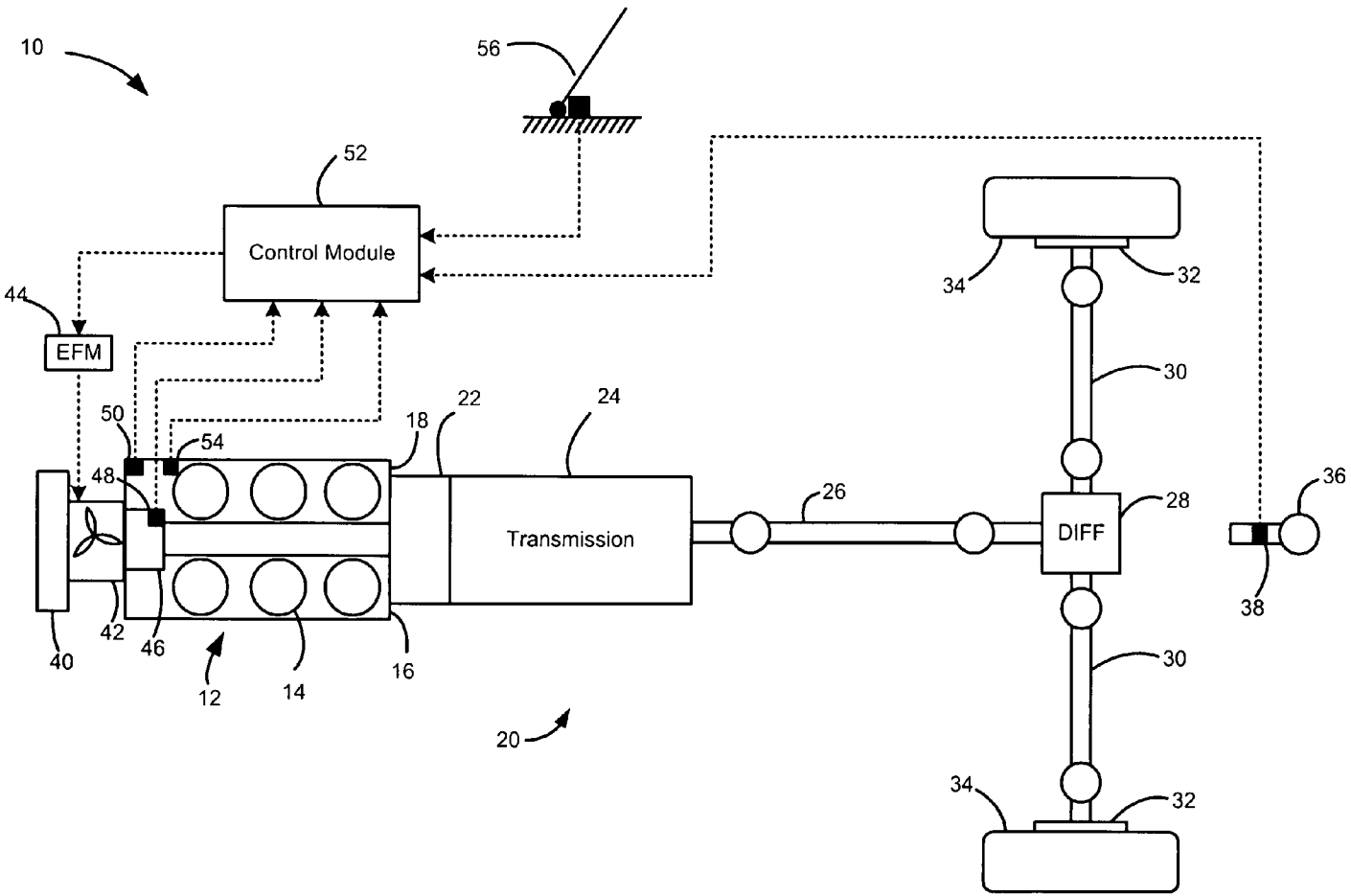
FIG. 1 is a diagram of a vehicle depicting components utilized according to the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. Additionally, the term "module" refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

Referring now to FIG. 1, a diagram of a vehicle 10 is depicted in which an engine 12 combusts an air-fuel mixture within one or more cylinders 14 to produce torque. The engine 12 may include six cylinders 14 that are configured in cylinder banks 16 and 18. Although six cylinders 14 are depicted, the engine 12 may include additional or fewer cylinders 14. Furthermore, the cylinders 14 of the engine 12 may be configured in any suitable configuration, such as a V-configuration, an inline-configuration, and a flat or horizontally opposing configuration.

The engine 12 transfers the torque to a driveline system 20. The driveline system 20 includes a flexplate or flywheel (not shown), a torque converter or other coupling device 22, a transmission 24, a drive or propeller shaft 26, a differential 28, axle shafts 30, brakes 32 and driven wheels 34. The vehicle 10 may include a trailer hitch 36 that may be used to tow a trailer. A towing load sensor 38 generates a towing load signal based on a towing load sensed at the trailer hitch 36.

The combustion of the air-fuel mixture within the cylinders 14 generates heat. Fluid (e.g., coolant) circulates through and absorbs or extracts heat from the engine 12, carries the heat to a radiator 40 where air passes through the radiator 40. As the air passes through the radiator 40, heat from the coolant transfers into the radiator material and then as the air passes through the radiator, heat emanating from the radiator is transferred by convection into the air. In this manner, the air passing through the radiator 40 removes heat from the coolant and cools the coolant, which may again circulate around the engine 12 to again remove heat from combustion.

Little or no air may pass through the radiator 40 when the vehicle 10 is stationary or moving slowly. Accordingly, the coolant may be unable to release or transfer heat when the vehicle 10 is stationary or moving slowly. The engine 12 and/or the coolant may be damaged when the coolant is unable to sufficiently release the heat to the air passing through the radiator 40.

The vehicle 10 may include a cooling fan 42 to facilitate the airflow, that is increase the flow rate, through the radiator 40. Although a single cooling fan 42 is depicted, the vehicle 10 may include more than one cooling fan 42. The cooling fan 42 may be controlled by a cooling fan control signal and may be driven by an electric fan motor (EFM) 44. By increasing the airflow passing the radiator 40, the cooling fan 42 may aid in transferring the heat from the coolant to the air passing the radiator 40. The increased airflow facilitated by use of the cooling fan 42 may be especially beneficial in extracting heat from the coolant when the vehicle 10 is stationary or moving slowly.

The cooling fan 42 may also increase airflow within an engine compartment (not shown) of the vehicle 10. Accordingly, the cooling fan 42 may also aid in cooling "under the hood" components associated with the engine 12, such as one or more electronic components 46. The electronic components 46 may include, for example, a motor generator unit, a starter, an ignition system, and/or a belt alternator starter (BAS). The BAS may, for example, shut down the engine 12 when the vehicle 10 is stopped and/or start the engine 12 to accelerate the vehicle 10 from a stop.

A component temperature sensor 48 generates a component temperature signal based upon the temperature of one of the electronic components 46. Although one component temperature sensor 48 is shown, one or more component temperature sensors 48 may be provided for each of the electronic components 46. Although the component temperature sensor 48 is depicted as included within the electronic component 46, the component temperature sensor 48 may be mounted externally to the electronic component 46.

A coolant temperature sensor 50 generates a coolant temperature signal based upon the temperature of the engine coolant. Although the coolant temperature sensor 50 is depicted as being located within the engine 12, the coolant temperature sensor 50 may be located anywhere that the coolant is contained, such as within the radiator 40.

A control module 52 receives one or more component temperature signals and the coolant temperature signal, collectively referred to as input temperature signals. The control module 52 generates a cooling fan control signal based upon the input temperature signals. Additionally, the control module 52 may generate the cooling fan control signal based upon a vehicle speed signal, a tow-haul signal, and the towing load signal.

The control module 52 may receive the vehicle speed signal from, for example, a vehicle speed sensor 54. The vehicle speed sensor 54 may generate the vehicle speed signal based upon any suitable measure of vehicle speed, such as engine output speed or transmission output speed. The control module 52 may receive a tow-haul signal from a driver interface 56. The driver interface 56 may generate the tow-haul signal based on whether a driver has selected a tow-haul operation. Alternatively, the control module 52 may receive the towing load signal from the towing load sensor 38.

Figure 2A:
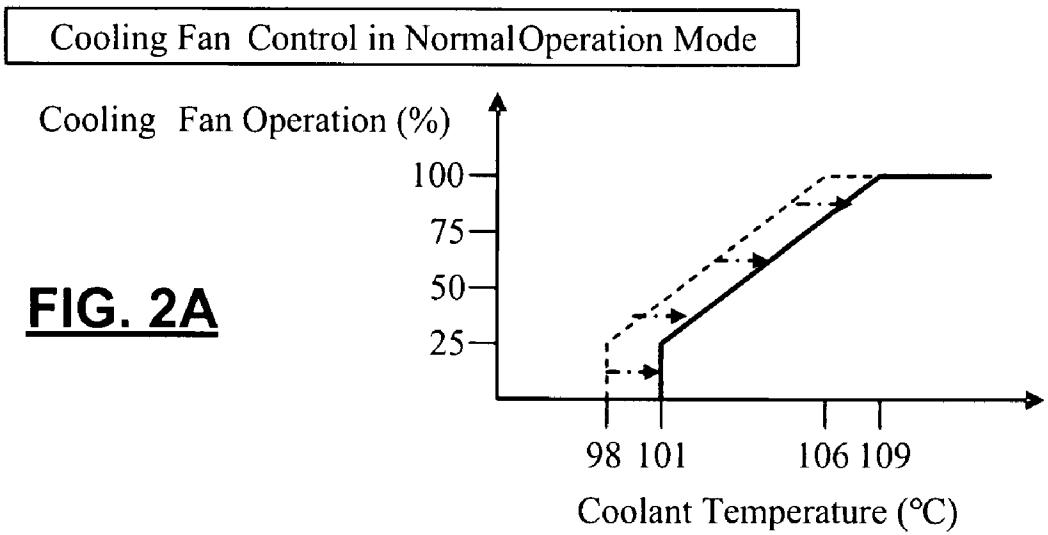
FIG. 2A is a graph depicting a cooling fan control mode during a normal vehicle load.
Figure 2B:
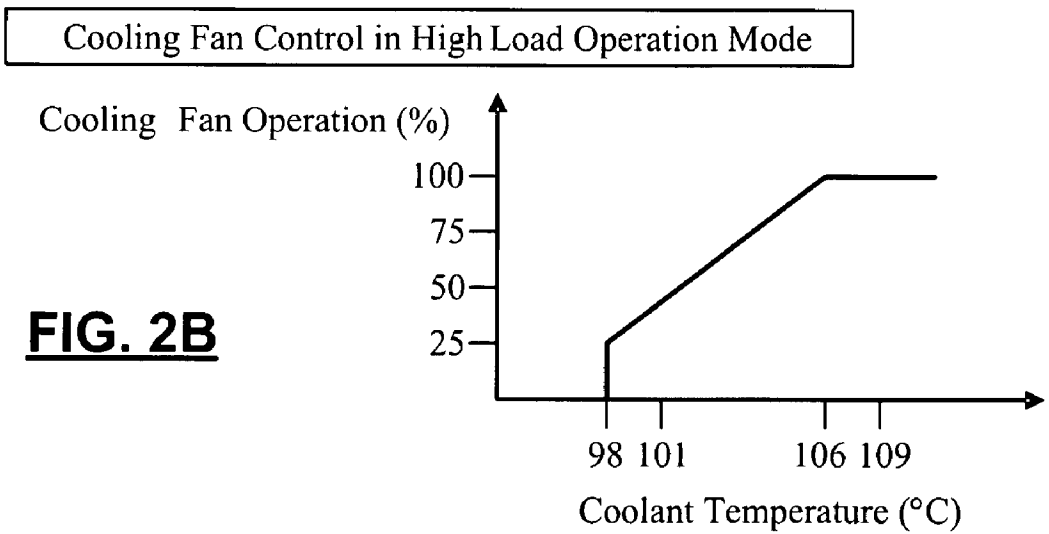
FIG. 2B is a graph depicting a cooling fan control mode during a high load operation.

Referring now to FIG. 2A, a graph illustrates exemplary cooling fan control in normal operation mode while the graph of FIG. 2B illustrates exemplary cooling fan control in high-load operation mode. In the graphs of FIGS. 2A and 2B, the x-axis represents the coolant temperature in degrees Celsius determined from the coolant temperature sensor 50 and the y-axis represents a cooling fan operation percentage. The cooling fan operation percentage affects cooling fan power. Typically, cooling fan operation is not initiated until the coolant temperature exceeds a temperature threshold, that is, the temperature rises to a particular temperature. Once the temperature threshold is met or exceeded, the cooling fan operation percentage is increased until it reaches 100% (i.e., maximum cooling capacity). Such an increase in cooling fan operation may mean increasing the velocity of the fan.

In the high-load operation mode depicted in FIG. 2B, the cooling fan operation percentage is determined at a coolant temperature based on a maximum vehicle load. The maximum vehicle load may correspond to a vehicle loaded to a maximum allowable weight while towing a trailer. The cooling fan operation percentage is increased from 0% to 25% when the coolant temperature reaches or exceeds a temperature threshold of 98° C. As the coolant temperature increases above the temperature threshold, the cooling fan operation percentage is increased until it reaches 100% at a coolant temperature of 106° C. Beyond 106° C., the cooling fan operation percentage remains at 100%.

In the normal operation mode depicted in FIG. 2A, the temperature threshold is increased, relative to the high-load operation mode, to limit the cooling fan operation percentage when the vehicle load is below the vehicle load threshold. The cooling fan operation percentage is increased from 0% to 25% when the coolant temperature reaches or exceeds a temperature threshold of 101° C. As the coolant temperature increases above the temperature threshold, the cooling fan operation percentage is increased until it reaches 100% at a coolant temperature of 109° C. Thus, the normal operation mode reduces the cooling operation frequency relative to the high-load operation mode since the coolant temperature must exceed a higher temperature threshold to initiate cooling fan operation. The normal operation mode also decreases the cooling fan operation percentage relative to the high-load operation mode over a predetermined coolant temperature range from the temperature threshold to the coolant temperature corresponding to maximum capacity in the high-load operation mode.

FIGS. 2A and 2B depict the cooling fan control continuously adjusting the cooling fan operation percentage from 25% to 100% via pulse width modulation based on the coolant temperature and normal and high-load operation modes. However, the cooling fan operation may also be adjusted in accordance with the cooling fan control of the present disclosure using a finite number of control points. For example, trigger points for a two-speed fan controlled by a series and parallel relay circuit may be adjusted based on normal and high-load operation modes. In addition, the cooling fan control of the present disclosure may be based on vehicle parameters other than the coolant temperature (e.g., A/C system pressure, transmission oil temperature, charge air temperature, engine air inlet temperature).

Figure 3:
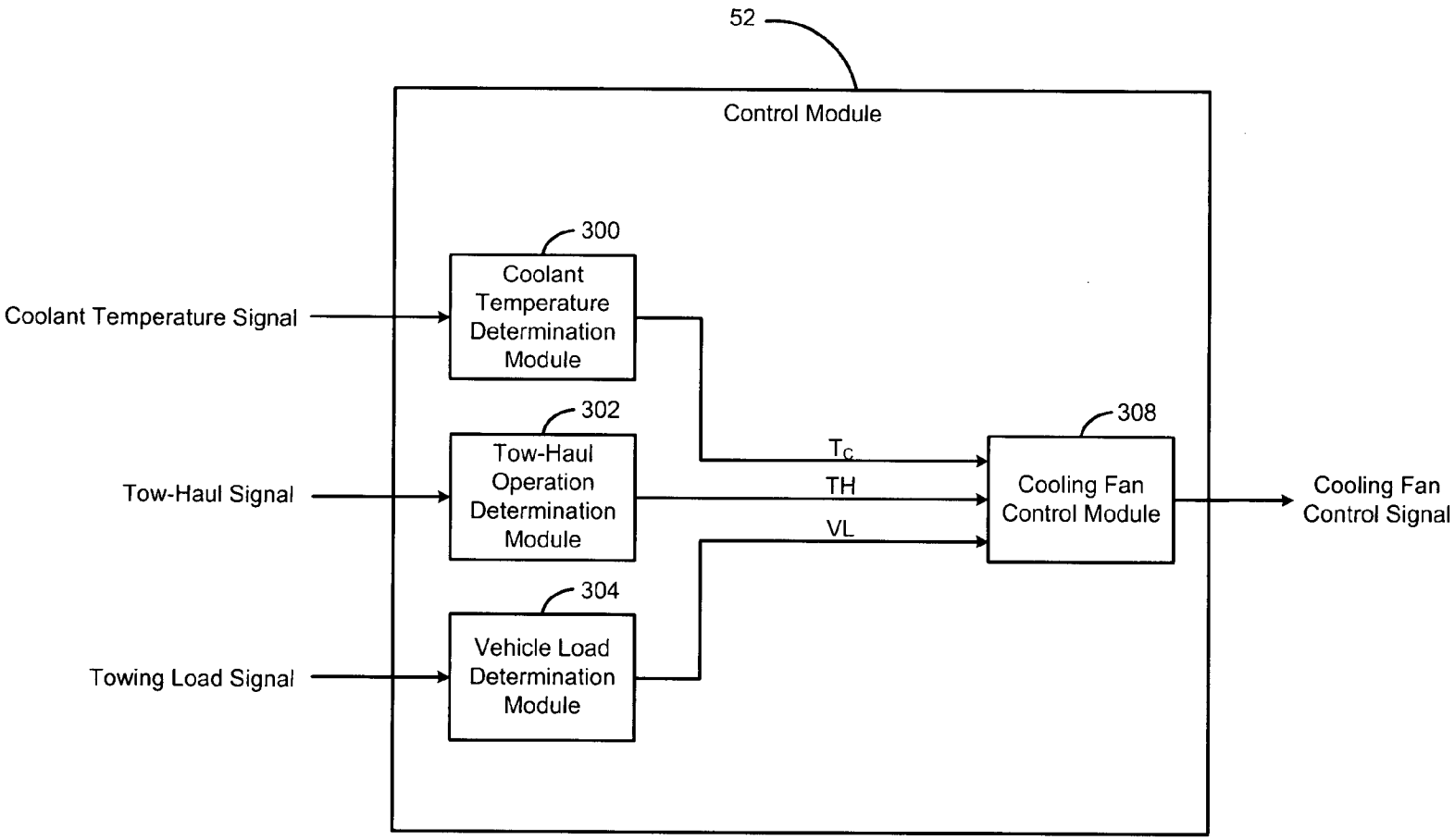
FIG. 3 is a diagram depicting control modules that assist in executing the cooling fan control of the present disclosure.

Referring now to FIG. 3, exemplary modules that execute the cooling fan control will be described in detail. The control module 52 includes a coolant temperature determination module 300, a tow-haul operation determination module 302, a vehicle load determination module 304, and a cooling fan control module 308. The coolant temperature determination module 300 receives a coolant temperature signal from the coolant temperature sensor 50 and determines the coolant temperature ($T_C$) based thereon. The tow-haul operation determination module 302 receives the tow-haul signal from the driver interface 56 and determines a tow-haul operation state (TH) based thereon. The vehicle load determination module 304 receives a towing load from a towing load sensor 38 and determines a vehicle load (VL) based thereon. $T_C$, TH, and VL are output to the cooling fan control module 308.

The cooling fan control module 308 determines a cooling fan operation percentage based on $T_C$ and either TH or VL. The cooling fan control module 308 generates a cooling fan control signal based on the cooling fan operation percentage and outputs the cooling fan control signal.

Referring now to the flowchart of FIG. 4, the flow of logic or steps performed by the cooling fan control of the present invention will be described in detail. In step 400, control determines $T_C$ based on the coolant temperature signal received from the coolant temperature sensor 50. In step 402, control determines TH based on the tow-haul operation signal received from the driver interface 56. In step 404, control determines whether tow-haul operation is selected based on TH. If tow-haul operation is selected, control assumes VL exceeds $VL_{THR}$ (vehicle load threshold) and determines the cooling fan operation percentage based on $T_C$ and the high-load operation mode in step 406. If tow-haul operation is not selected, control determines VL based on the vehicle load signal from the towing load sensor 38 in step 408.

In step 410, control determines whether VL exceeds $VL_{THR}$. If VL exceeds $VL_{THR}$, control determines the cooling fan operation percentage based on $T_C$ and the high-load operation mode in step 406. If VL does not exceed $VL_{THR}$, control determines the cooling fan operation percentage based on $T_C$ and the normal operation mode in step 412. When the control logic reaches "End," the control begins again at "Start."

Figure 4:
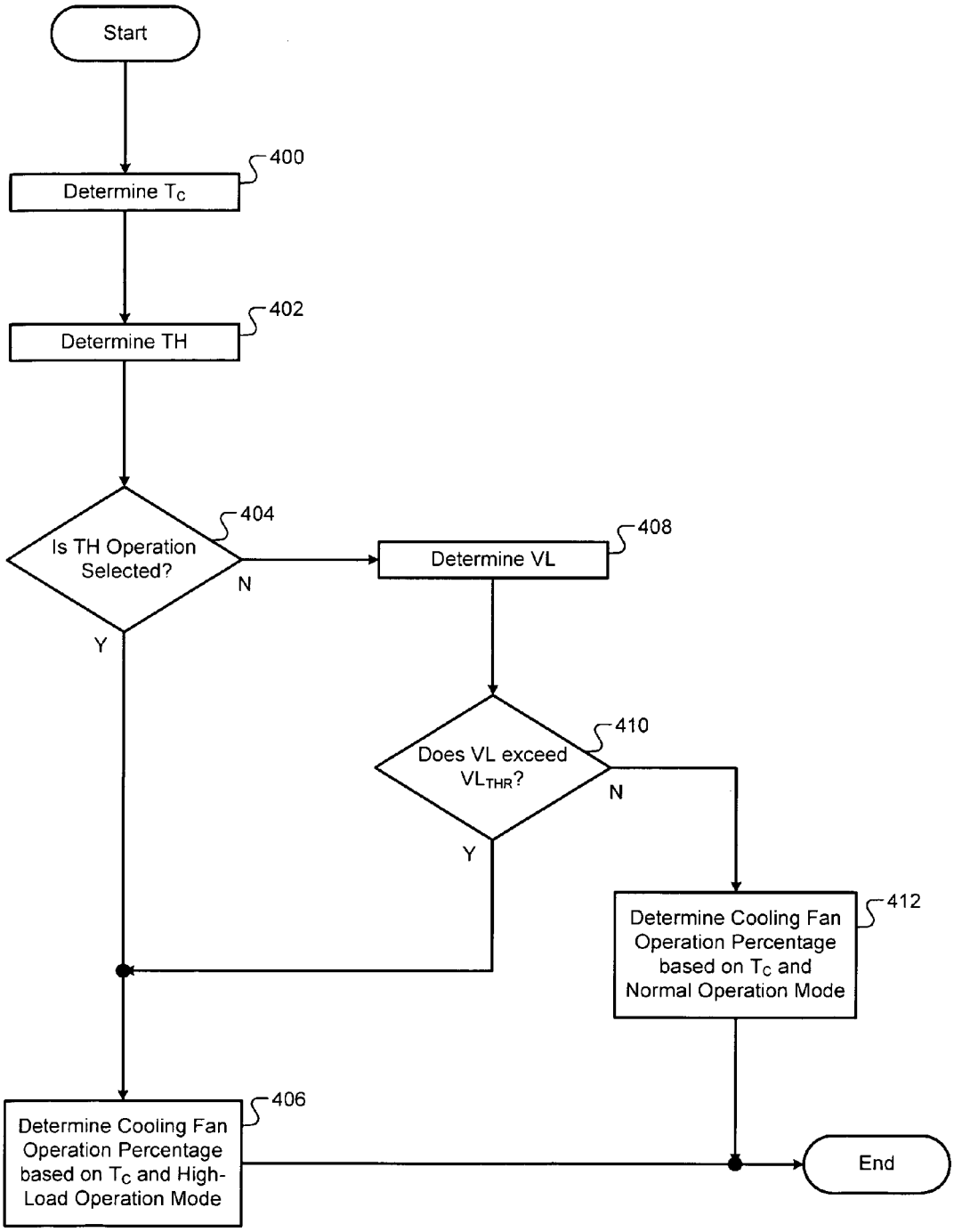
FIG. 4 is a flowchart depicting steps executed by the cooling fan control of the present disclosure.

In addition to the explanation of the present disclosure presented above, a method of controlling a cooling fan for an engine of a vehicle, such as depicted in FIG. 4, may entail determining an engine coolant temperature $T_c$ using a coolant temperature sensor 50 in the engine 12, determining whether a tow-haul operation is selected, such as with a driver interface 56 as a type of manual switch within a vehicle, providing a high load operation mode for the cooling fan as depicted in FIG. 2B, and determining an operation percentage of the cooling fan 42 based on the engine coolant temperature Tc and the high load operation mode for the cooling fan 42. The driver interface 56 to engage a tow-haul operation of the vehicle may also be a screen interface, and not a traditional manual switch. A screen interface could be an LCD screen. Determining an operation percentage of the cooling fan based on the engine coolant temperature Tc and the high load operation mode for the cooling fan is performed when the tow-haul operation is selected within a vehicle. The operation percentage of the cooling fan may be in accordance with FIG. 2B. For instance, with a coolant temperature Tc of 98 degrees Celsius, the cooling fan 42 may operate at 25% of its capacity and increase as the coolant temperature Tc rises, up to 100% of the cooling fan capacity. Additionally, the frequency of operation of the cooling fan may change. That is, the cooling fan 42 may be turned on and off depending upon the temperature of the engine coolant.

In another example, a method of controlling a cooling fan 42 for an engine 12 of a vehicle 10 may entail determining an engine coolant temperature Tc using a coolant temperature sensor 50 in an engine 12, providing a normal load operation mode for the cooling fan 42 and a high load operation mode for the cooling fan 42. Such modes controlled by the control module 52, and more specifically, additional modules 300, 302, 304, 308 within the control module 52. Continuing, the method may entail determining whether a tow-haul operation is selected or is not selected within the vehicle. Such selection may be made with a driver interface 56, which may be a manual switch or an LCD screen, for example. The method may also entail determining a vehicle load of the vehicle and determining whether a vehicle load exceeds a vehicle load threshold. Determining whether a tow-haul operation is selected or is not selected within the vehicle means determining if a user controlled switch is activated or not activated. Determining a vehicle load of the vehicle may mean determining if a towing load sensor is activated or not activated. After determining whether a vehicle load exceeds a vehicle load threshold, the method may further entail determining an operation percentage of the cooling fan based on the engine coolant temperature Tc and the high load operation mode for the cooling fan. Furthermore, determining an operation frequency of the cooling fan 42 may be based on the engine coolant temperature Tc and the high load operation mode (FIG. 2B) for the cooling fan 42. The vehicle load threshold may be that weight at which the high load operation mode (FIG. 2) is utilized.

After determining whether a vehicle load exceeds a vehicle load threshold, the method may further entail determining an operation percentage, for example, 25%-100% or any operational percentage between 25% and 100%, of the cooling fan 42 based on the engine coolant temperature $T_c$ and the normal load operation mode for the cooling fan 42. The operation frequency of the cooling fan 42 may be based on the engine coolant temperature Tc and the normal load operation mode for the cooling fan 42.

In another example, a method of controlling a cooling fan 42 for an engine 12 of a vehicle 10 may entail determining an engine coolant temperature Tc, providing a normal load operation mode for the cooling fan 42 and a high load operation mode for the cooling fan 42, determining whether a tow-haul operation is selected or is not selected within the vehicle 10, determining a vehicle load of the vehicle 10 by detecting whether a towing load sensor 38 is activated (being used) or not activated (not being used), determining whether a vehicle load threshold $VL_{THR}$ is reached based upon activation of the towing load sensor, and operating the cooling fan 42. The method may further entail operating the cooling fan 42 based on the coolant temperature Tc and one of the normal load operation mode and the high load operation mode (FIGS. 2A and 2B). As an example, operating the cooling fan in the normal load operation mode may entail reducing a cooling fan operation frequency and decreasing a cooling fan operation percentage over a predetermined coolant temperature Tc range relative to operating the cooling fan in the high load operation mode.

In yet another example, a method of controlling a cooling fan 42 for an engine 12 of a vehicle 10 may entail determining whether a tow-haul switch is activated in the vehicle, determining a vehicle load, and controlling a cooling fan in the vehicle based on the tow-haul operation and the vehicle load. The method may further entail determining a coolant temperature Tc for the vehicle, comparing the vehicle load (in pounds or kilograms), to a vehicle load threshold, operating the cooling fan 42 in a high-load operation mode when the vehicle load exceeds the vehicle load threshold, and operating the cooling fan 42 in a normal operation mode when the vehicle load is below the vehicle load threshold $VL_{THR}$. The method may further entail determining a cooling fan operation percentage based on the coolant temperature Tc and one of the high load operation mode and the normal operation mode. Such operation percentages may be in accordance with FIGS. 2A and 2B. The method may further entail determining a cooling fan operation percentage at the coolant temperature Tc based on a maximum vehicle load when operating the cooling fan 42 in a high load operation mode (FIG. 2B).

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A method of controlling a cooling fan for an engine of a vehicle, the method comprising:

determining an engine coolant temperature;

providing a normal load operation mode for the cooling fan and a high load operation mode for the cooling fan;

determining whether a tow-haul operation is selected or is not selected within the vehicle by determining if a user controlled manual switch is activated or not activated; and determining a vehicle load of the vehicle;

determining whether the vehicle load exceeds a vehicle load threshold; and turning the cooling fan on and off depending upon a temperature of the engine coolant temperature.

2. The method of controlling a cooling fan according to claim 1, wherein the method step of determining a vehicle load of the vehicle comprises determining if a towing load sensor is activated or not activated.

3. The method of controlling a cooling fan for an engine of a vehicle according to claim 2, wherein after the method step of determining whether a vehicle load exceeds a vehicle load threshold, the method further comprising:

determining an operation percentage of the cooling fan based on the engine coolant temperature and the high load operation mode for the cooling fan.

4. The method of controlling a cooling fan for an engine of a vehicle according to claim 3, further comprising:

determining an operation frequency of the cooling fan based on the engine coolant temperature and the high load operation mode for the cooling fan.

5. The method of controlling a cooling fan for an engine of a vehicle according to claim 2, wherein after the method step of determining whether a vehicle load exceeds a vehicle load threshold, the method further comprising:

determining an operation percentage of the cooling fan based on the engine coolant temperature and the normal load operation mode for the cooling fan.

6. The method of controlling a cooling fan for an engine of a vehicle according to claim 5, further comprising:

determining an operation frequency of the cooling fan based on the engine coolant temperature and the normal load operation mode for the cooling fan.

* * * * *

UNITED STATES PATENT AND TRADEMARK OFFICE

CERTIFICATE OF CORRECTION

PATENT NO. : 8,015,953 B2
APPLICATION NO. : 12/079137
DATED : September 13, 2011
INVENTOR(S) : Bryan Anthony Stramecki It is certified that error appears in the above-identified patent and that said Letters Patent is hereby corrected as shown below:

Col. 5, line 63, "Tc" should be -- $T_c$ --

Col. 6, line 2, "Tc" should be -- $T_c$ --

Col. 6, line 6, "Tc" should be -- $T_c$ --

Col. 6, line 8, "Tc" should be -- $T_c$ --

Col. 6, line 15, "Tc" should be -- $T_c$ --

Col. 6, line 35, "Tc" should be -- $T_c$ --

Col. 6, line 38, "Tc" should be -- $T_c$ --

Col. 6, line 49, "Tc" should be -- $T_c$ --

Col. 6, line 53, "Tc" should be -- $T_c$ --

Col. 6, line 63, "Tc" should be -- $T_c$ --

Col. 7, line 1, "Tc" should be -- $T_c$ --

Col. 7, line 10, "Tc" should be -- $T_c$ --

Col. 7, line 17, "Tc" should be -- $T_c$ --

Col. 7, line 22, "Tc" should be -- $T_c$ --

Signed and Sealed this
Twenty-second Day of November, 2011

David J. Kappos

David J. Kappos
*Director of the United States Patent and Trademark Office*